US005206458A

United States Patent [19]

Nishikawa

[11] Patent Number: 5,206,458

[45] Date of Patent: Apr. 27, 1993

[54] DEVELOPING APPARATUS

[75] Inventor: Yoshikazu Nishikawa, Nara, Japan

[73] Assignee: Sharp Kabushiki Kaisha, Osaka, Japan

[21] Appl. No.: 808,057

[22] Filed: Dec. 12, 1991

Related U.S. Application Data

[63] Continuation of Ser. No. 564,626, Aug. 8, 1990, abandoned, which is a continuation of Ser. No. 287,780, Dec. 21, 1988, abandoned.

[30] Foreign Application Priority Data

Dec. 21, 1987 [JP] Japan ..... 62-324790

[51] Int. Cl.[5] ..... G03G 15/09

[52] U.S. Cl. ..... 118/658; 355/251

[58] Field of Search ..... 355/251, 253, 245, 215; 118/657, 658

[56] References Cited

U.S. PATENT DOCUMENTS 4,377,334 3/1983 Nishikawa ..... 355/251 X
4,676,192 6/1987 Yuge et al. ..... 118/658
4,746,952 5/1988 Kusuda et al. ..... 118/657 X

FOREIGN PATENT DOCUMENTS 0228474 10/1986 Japan ..... 355/251

*Primary Examiner*—A. T. Grimley
*Assistant Examiner*—Robert Beatty
*Attorney, Agent, or Firm*—Morrison & Foerster

[57] ABSTRACT

In a developing apparatus in electrophotographic machines, the surface of a developer guide facing the surface of a magnetic roller includes a first surface area and a second surface area. The first and second surface areas are curved along the surface of the magnetic roller with a space therebetween, and the second surface area is located downstream of the first surface area. The distance between the first surface area of the developer guide and a portion of the surface of the magnetic roller corresponding to the first surface area is larger than the distance between the second surface area of the developer guide and a portion of the surface of the magnetic roller corresponding to the second surface area. A brush of the developer is formed on the surface of the magnetic roller and touches onto the first surface area of the developer guide.

6 Claims, 5 Drawing Sheets

DEVELOPING APPARATUS

This application is a continuation of application Ser. No. 564,626, filed Aug. 8, 1990, now abandoned, which is a continuation of Ser. No. 287,780, filed Dec. 21, 1988, now abandoned.

BACKGROUND OF THE INVENTION

1. Field of the Invention

This invention relates to a developing apparatus in electrophotographic machines such as copying machines.

2. Description of the Prior Art

Conventional electrophotographic machines such as copying machines have, as shown in FIG. 4, a developing apparatus 1 and a toner supply box 2 from which toner is supplied to the developing apparatus 1. In the developing apparatus 1, agitation rollers 3 and 4 admix the toner with a carrier such as iron powder or the like and agitate the mixture, resulting in a developer. The developer is fed to a magnet roller 5 by the agitation rollers 3 and 4. The magnet roller 5 is composed of a sleeve 51 and a plurality of magnets 52 with two main polarities $N_1$ and $N_2$ and three supplementary polarities $S_1$, $S_2$ and $S_3$. The polarity $S_1$ is positioned between the $N_1$ and $N_2$ and the polarity $S_2$ is positioned between the $S_3$ and $N_1$. By means of these polarities $N_1$-$N_2$ and $S_1$-$S_3$, the developer attaches to the sleeve 51 that is disposed around the magnets 52, and is sent to a photosensitive drum 6 while the sleeve 51 rotates around the magnet 52 by a driving means (not shown). Since the carrier bearing the toner is made of magnetic material such as iron powder or the like, the carrier adheres to the surface of the sleeve 51 and forms a magnetic brush thereon in the direction of magnetic lines of force of the magnets 52. The direction and the density of the magnetic lines of the developer on the sleeve 51 vary as the sleeve 51 turns. Toner constituting the magnetic brush is supplied to the photosensitive drum 6 by the rotation of the sleeve 51.

Above the magnetic roller 5, a doctor blade 7 is provided as a means to regulate the amount of developer to be carried toward the photosensitive drum 6. There is a developer cover 8 downstream of the doctor blade 7 in the direction of conveyance of the developer. The tip of this doctor blade 7 is near the surface of the sleeve 51 of the magnetic roller 5 so as to regulate the amount of developer that is attached to the sleeve 51, so that a suitable amount of developer can be conveyed toward the photosensitive drum 6.

However, in the conventional developing apparatus with the above-mentioned construction, toner is blown into the direction of the developer cover 8 from the gap between the tip of the doctor blade 7 and the surface of the sleeve 51 because there is a pressure depression in the area of the downstream side of the doctor blade 7 in the direction of conveyance of the developer (i.e., in the area of the developer cover side). The toner, being a movable powder, is not held in a space between the developer cover 8 and the sleeve 51 of the magnetic roller 5, but is blown towards the outside of this developing apparatus 1. Thus, an appropriate amount of toner cannot be supplied to the photosensitive drum 6, so that an electrostatic latent image that has been formed on the photosensitive drum 6 cannot be uniformly developed by the toner.

SUMMARY OF THE INVENTION

The developing apparatus of this invention, overcomes the above-discussed and numerous other disadvantages and deficiencies of the prior art. A magnetic roller is composed of a plurality of magnets with main polarities and supplementary polarities and a sleeve disposed around said magnets. The magnetic roller supplies a developer to a photosensitive drum while said sleeve rotates relative to the magnets. On the surface of the sleeve, the developer is formed into a brush by magnetic lines of said magnets. A developer-regulating means that regulates the amount of developer is adhered to the surface of said sleeve. A guiding means for guiding the stream of developer is disposed downstream of said developer-regulating means in the direction of conveyance of said developer. The surface of said guiding means that faces the surface of said magnetic roller is composed of a first surface area and a second surface area, both of which are curved along the surface of said magnetic roller with a space therebetween. The second surface area of said guiding means is located downstream of the first surface area thereof, and the distance between the first surface area of said guiding means and the surface area of said magnetic roller that corresponds to the first surface area of said guiding means is larger than the distance between the second surface area of said guiding means and the surface area of said magnetic roller that corresponds to the second surface area of said guiding means. The brush of said developer touches onto the first surface area of said guiding means.

In a preferred embodiment, the second surface area of said guiding means has the same curvature as the surface of said magnetic roller to a certain extent.

In a preferred embodiment, the surface including the first and second surface areas of said guiding means is constituted by the bottom surface of a developer cover that is disposed downstream of said developer-regulating means.

In a preferred embodiment, the developer-regulating means is a doctor blade.

In a preferred embodiment, the developer is made of a single- or two-component developer.

Thus, the invention described herein makes possible the objective of providing a developing apparatus in electrophotographic machines that prevents the blowing of toner in the downstream direction of the developer-regulating means from the gap between the developer-regulating means and the surface of a sleeve, so that an appropriate amount of toner can be supplied to the photosensitive drum on which an electrostatic latent image has been formed, resulting in a uniform toner image on the photosensitive drum.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
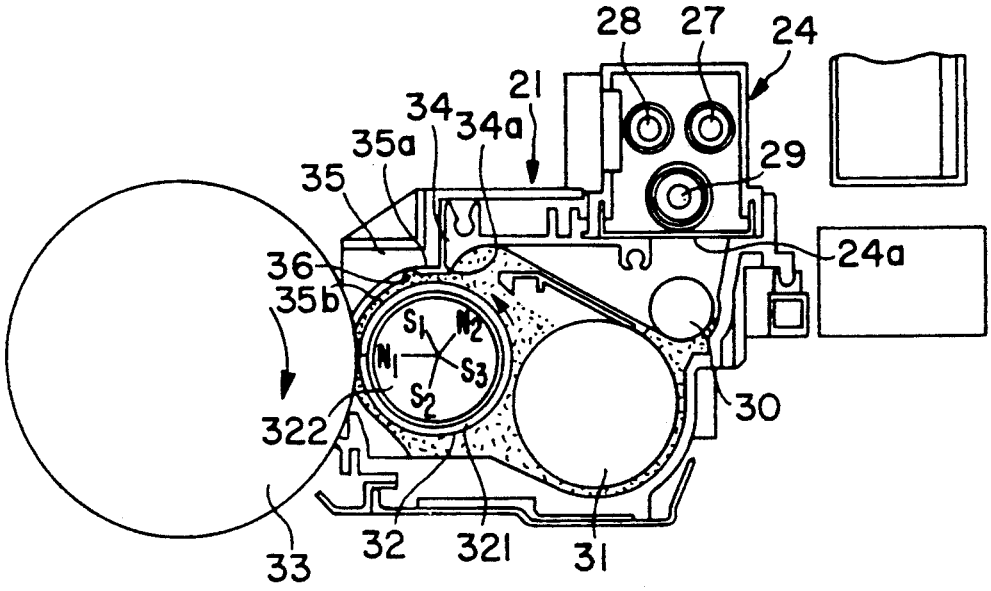
FIG. 1 is a sectional view showing a developing apparatus of this invention.
Figure 2:
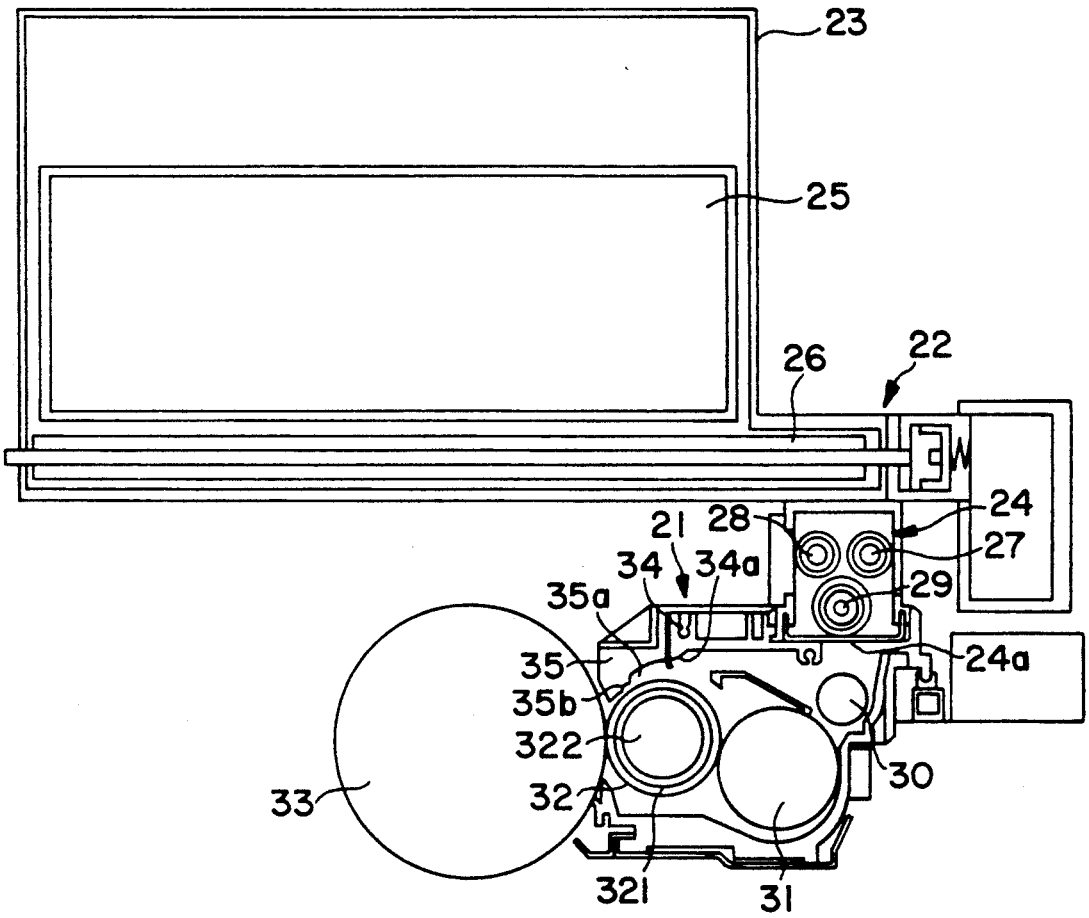
FIG. 2 is a sectional view showing the developing apparatus of FIG. 1 with a toner hopper.
Figure 5:
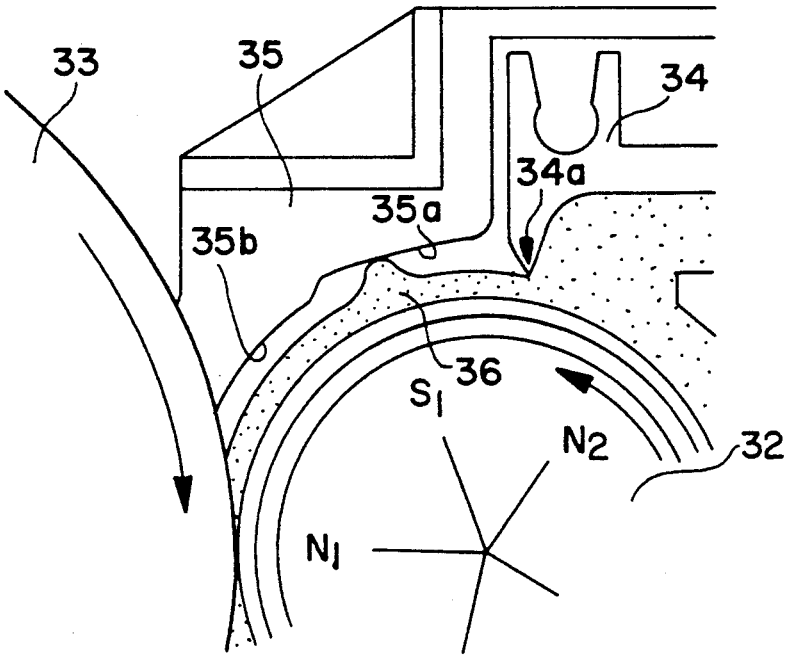
FIG. 5 is a sectional view showing the guide surfaces of the developer cover.

A copying machine of this invention that is an electrophotographic machine has, as shown in FIGS. 1, 2 and 5, a developing apparatus 21 and a toner hopper 22 that is disposed above the developing apparatus 21. The toner hopper 22 has a toner box 23 that contains toner therein, and a toner conveyance box 24 that supply the toner from the toner box 23 to the developing apparatus 21.

The above-mentioned toner box 23 has a toner agitation roller 25 that agitates the toner therein and a toner supply screw 26 that introduces the toner from the toner box 23 into the toner conveyance box 24. The toner conveyance box 24 has a pair of toner conveyance screws 27 and 28 and a toner supply roller 29 that is made of a sponge or the like. The pair of toner conveyance screws 27 and 28 are disposed in a parallel manner so as to be synchronized with the same rotational speeds in the opposite direction thereby circulating and uniforming the toner within the toner conveyance box 24. The toner supply roller 29 is disposed to be parallel to the screws 27 and 28, and introduces toner from the toner conveyance box 24 into the developing apparatus 21 through a hole 24*a* that is formed at the bottom wall of the toner conveyance box 24.

The developing apparatus 21 has agitation rollers 30 and 31 and a magnetic roller 32. The toner that has been introduced from the above-mentioned toner conveyance box 24 into the developing apparatus 21 is admixed and agitated with the carrier of iron powder, resulting in a developer, which is then supplied to the magnetic roller 32 by means of the agitation rollers 30 and 31. The magnetic roller 32 is composed of a sleeve 321 and a plurality of magnets 322 disposed inside the sleeve 321. The sleeve 321 rotates counterclockwise relating to the magnets 322. In this example, the magnet 322 is held by a fixing means (not shown) and the sleeve 321 is rotatable around the magnets 322 by means of a driving means (not shown).

The magnets 322 constituting the magnetic roller 32 have, for example, two main polarities $N_1$ and $N_2$ and three supplementary polarities $S_1$, $S_2$ and $S_3$ that cooperate with the main polarities $N_1$-$S_3$ to thereby carry the developer onto a photosensitive drum 33. One supplementary polarity $S_1$ is disposed between the main polarities $N_1$ and $N_2$ and the other supplementary polarity $S_2$ is between the main polarities $S_3$ and $N_1$. The main polarity $N_1$ is positioned at an area of the magnetic roller 32 that is the closest to the area of the surface of the photosensitive drum 33 to which the toner is fed from the sleeve 321 by the rotation of the sleeve 321. The supplementary polarity $S_1$ is positioned in the vicinity of the below-mentioned guiding means such as a developer cover 35 that guides the stream of developer.

The developer that has been supplied to the sleeve 321 of the magnetic roller 32 by the agitation rollers 30 and 31 magnetically adheres to the surface of the sleeve 321 and forms a brush 36 thereon in the direction of magnetic lines of force of the magnets 322. The developer is carried onto the photosensitive drum 33 as the sleeve 321 turns.

Above the magnetic roller 32, there is a developer-regulating means such as a doctor blade 34, the tip 34*a* of which is positioned near the surface of the sleeve 321 of the magnetic roller 32 and functions to regulate the amount of developer to be carried toward the photosensitive drum 33.

The developer cover 35 mentioned above is disposed between the doctor blade 34 and the photosensitive drum 33 (i.e., downstream from the doctor blade 34 in the direction of conveyance of the developer). The bottom surface of the developer cover 35 that faces the surface of the sleeve 321 is composed of a first surface area 35*a* and a second surface area 35*b*, both of which are curved along the surface of the sleeve 321 with a space therebetween in such a manner that the curvature of at least the second surface area 35*b* of the developer cover 35 is the same as that of the surface of the magnetic roller 32. The second surface area 35*b* of the developer cover 35 is located downstream of the first surface area 35*a* thereof. The distance between the first surface area 35*a* of the developer cover 35 and the area of the surface of the magnetic roller 32 that corresponds to the said area 35*a* of the developer cover 35 in the vicinity of the doctor blade 34 is larger than the distance between the second surface area 35*b* of the developer cover 35 and the area of the surface of the magnetic roller 32 that corresponds to the said area 35*b* of the developer cover 35 downstream from the first surface area 35*a* of the developer cover 35. The smaller the distance between the second surface area 35*b* of the developer cover 35 and the surface of the sleeve 321 (i.e., the surface of the magnetic roller 32) is, the more the prevention of the blowing of toner from the gap between the tip 34*a* of the doctor blade 34 and the surface of the sleeve 321 into the space between the developer cover 35 and the sleeve 321 is effectively attained as described below. The first surface area 35*a* of the developer cover 35 is positioned at a certain distance from the corresponding surface of the magnetic roller 32 in such a manner that the brush 36 of the developer formed on the sleeve 321 of the magnetic roller 32 touches onto the first surface area 35*a* of the developer cover 35.

Figure 3:
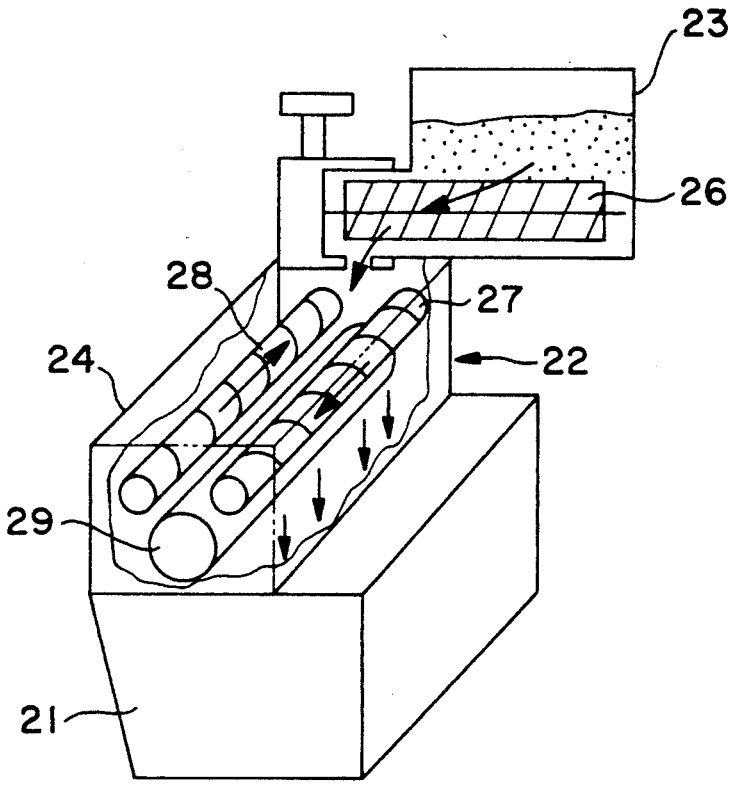
FIG. 3 is a schematic diagram showing the flowing of toner within the toner hopper of FIG. 2.
Figure 4:
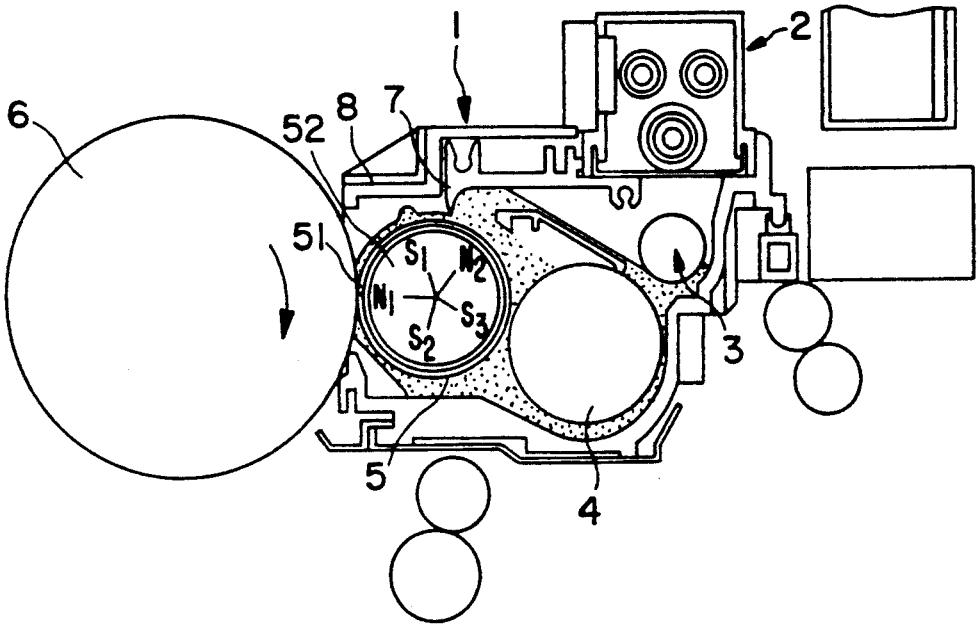
FIG. 4 PRIOR ART
FIG. 4 is a sectional view showing a conventional developing apparatus.

The developing apparatus 21 with the above-mentioned structure operates as follows: When the amount of toner in the toner conveyance box 24 becomes less than a fixed level, as shown in FIG. 3, the screw 26 of the toner box 23 rotates to send the toner of the toner box 23 to the toner conveyance box 24. Then, the screws 27 and 28 of the toner conveyance box 24 rotate to agitate the toner within the box 24.

On the other hand, when the toner of the developing apparatus 21 is used to develop an electrostatic latent image that has been formed on the surface of the photosensitive drum 33 in accordance with the manuscript to be copied and thus the concentration of the toner of the developer within the developing apparatus 21 becomes less than a fixed level, then the toner supply roller 29 of the toner conveyance box 24 rotates to introduce the toner therefrom into the developing apparatus 21 through the hole 24*a* in cooperation with the screws 27 and 28.

The toner that has been introduced into the developing apparatus 21 is admixed and agitated with a magnetic carrier by the agitation rollers 30 and 31, resulting in a developer. The developer is then sent to the magnetic roller 32 by the agitation rollers 30 and 31 and mainly adheres to the areas of the surface of the sleeve 321 that correspond to the polarities $N_1$–$N_2$ and $S_1$–$S_3$ of the magnets 322, so that the developer on the surface of the sleeve 321 is formed into a brush by magnetic lines of the magnets 322. The developer is carried toward the photosensitive drum 33 as the sleeve 321 rotates around the magnets 322. The amount of developer that is to be sent toward the photosensitive drum 33 is regulated to an appropriate level by the tip 34*a* of the doctor blade 34.

A pressure depression arises in a space between the first surface area 35*a* of the developer cover 35 and the area of the surface of the magnetic roller 32 that corresponds to the said surface area 35*a* of the developer cover 35, so that the toner within the developing apparatus 21 tends to be blown from the gap between the tip 34*a* of the doctor blade 34 and the surface of the magnetic roller 32 into the downstream area of the doctor blade 34. However, because the brush 36 that has been formed on the area of surface of the sleeve 321 corresponding to the supplementary polarity $S_1$ touches onto the first surface area 35*a* of the developer cover 35, the toner is sealed off by the brush 36. Moreover, because the distance between the first surface area 35*a* of the developer cover 35 and the corresponding surface area of the magnetic roller 32 is set to be larger than the distance between the second surface area 35*b* of the developer cover 35 and the corresponding surface area of the magnetic roller 32, the said larger space corresponding to the first surface area 35*a* of the developer cover 35 constitutes a kind of hollow. Thus, even though a part of the toner is blown from the gap between the tip 34*a* of the doctor blade 34 and the corresponding surface area of the magnetic roller 32 into the gap between the developer cover 35 and the sleeve 321 through the brush 36, the stream of blowing toner becomes turbulent in the said hollow, which makes the blowing of toner difficult. Moreover, because the second surface area 35*b* of the developer cover 35 is designed to be as close as possible to the corresponding surface area of the magnetic roller 32, it also functions to prevent the blowing of toner. Therefore, the developer that always contains an appropriate amount of toner is supplied toward the photosensitive drum 33, so that an electrostatic latent image that has been formed on the surface of the photosensitive drum 33 can be always developed by the appropriate amount of toner, resulting in a uniform toner image.

Although the above-mentioned example only discloses the use of a two-component developer that is composed of a non-magnetic toner and a magnetic carrier, this invention is, of course, applicable to the use of a single-component developer that is composed of a magnetic toner. When the developer used is made of a single component, the agitation rollers 30 and 31 can be omitted.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developing apparatus for electrophotographic machines comprising:

a magnetic roller including a magnet with a main polarity and a supplementary polarity and a rotating sleeve disposed around said magnet, said main polarity opposing a photosensitive drum and said supplementary polarity disposed upstream of said main polarity in the direction of rotation of said sleeve, said main polarity and said supplementary polarity being opposite in polarity to each other, said magnetic roller conveying a developer along the surface of said sleeve forming a magnetic brush on said sleeve at said supplementary polarity as said sleeve rotates, a developer-regulating means that is disposed upstream of said supplementary polarity for regulating the amount of developer conveyed on the surface of said sleeve, and a guiding means having a first surface area disposed downstream of said developer-regulating means in the direction of rotation of said sleeve extending downstream of said supplementary polarity, and a second surface area successively disposed downstream of said first surface area;

wherein said first surface area of said guide means is spaced from the surface of said sleeve to such an extent as to allow the magnetic brush to come into contact with said first surface area, said second surface area being closer to the surface of said sleeve than said first surface area, and said first surface area, the surface of said sleeve, said second surface area and said developer-regulator means forming a hollow within which said magnetic brush is formed, said hollow and said magnetic brush acting to prevent the escape of excess toner forced past said developer-regulator means.

2. A developing apparatus in electrophotographic machines according to claim 1, wherein the second surface area of said guiding means has approximately the same curvature as the surface of said magnetic roller.

3. A developing apparatus in electrophotographic machines according to claim 1 wherein the surface including the first and second surface areas of said guiding means is constituted by the bottom surface of a developer cover that is disposed downstream of said developer-regulating means.

4. A developing apparatus in electrophotographic machines according to claim 1 wherein said developer-regulating means is a doctor blade.

5. A developing apparatus in electrophotographic machines according to claim 1 wherein said developer is made of a single- or two-component developer.

6. The developing apparatus of claim 1, wherein said hollow is configured such that the toner forced past said developer-regulator means and flowing in said hollow is turbulent.

* * * * *